US005697127A

United States Patent [19]

Tyler

[11] Patent Number: 5,697,127

[45] Date of Patent: Dec. 16, 1997

[54] CONTAINER FOR MONEY CLIP

[76] Inventor: Robert T. Tyler, 2605 Judd St. SE., Lacey, Wash. 98503

[21] Appl. No.: 651,116

[22] Filed: May 21, 1996

[51] Int. Cl.[6] ..... A44B 21/00; B65D 85/00

[52] U.S. Cl. ..... 24/3.7; 24/3.12; 24/545; 206/69

[58] Field of Search ..... 24/3.7, 3.12, 545, 24/336, 712.3; 206/37, 69

[56] References Cited

U.S. PATENT DOCUMENTS

| | | | |
|---|---|---|---|
| D. 283,844 | 5/1986 | Saad et al. | D2/430 |
| D. 339,286 | 9/1993 | Kelsey et al. | D9/339 |
| D. 349,398 | 8/1994 | Ezzo | D3/208 |
| 395,515 | 1/1889 | Robertson | 206/37 |
| 727,402 | 5/1903 | Messer . | |
| 1,397,232 | 11/1921 | Prickett . | |
| 1,573,239 | 2/1926 | Gilliland | 24/3.7 |
| 2,447,996 | 8/1948 | Biagi | 24/545 |
| 3,100,494 | 8/1963 | Littman | 133/6 |
| 3,163,385 | 12/1964 | Lazan, Jr. | 24/336 |
| 3,777,953 | 12/1973 | Lewis | 224/4 C |
| 3,861,002 | 1/1975 | Gordon | 24/81 |
| 4,020,532 | 5/1977 | Lichter | 24/545 |
| 4,119,249 | 10/1978 | Hanson | 224/26 R |
| 4,148,114 | 4/1979 | Wier | 24/67.9 |
| 4,378,885 | 4/1983 | Leopoldi et al. | 206/540 |
| 4,659,000 | 4/1987 | Sales et al. | 24/3.7 |
| 4,675,953 | 6/1987 | Higgs | 24/499 |
| 4,768,648 | 9/1988 | Glass | 24/3.12 |
| 4,784,199 | 11/1988 | Wise | 150/134 |
| 4,903,745 | 2/1990 | Roman | 150/134 |
| 4,915,215 | 4/1990 | Brekke | 206/39 |
| 5,103,884 | 4/1992 | Roman | 150/134 |
| 5,115,909 | 5/1992 | Hull et al. | 206/38 |
| 5,427,233 | 6/1995 | Binck et al. | 206/69 |

FOREIGN PATENT DOCUMENTS

| | | | |
|---|---|---|---|
| 0015331 | of 1915 | United Kingdom | 24/545 |

*Primary Examiner*—Victor N. Sakran
*Attorney, Agent, or Firm*—R. Reams Goodloe, Jr.

[57] ABSTRACT

A sealed container for pills on a clip such as a money clip. Preferably, the container is hermetically sealed and suitable for holding moisture sensitive pills in a fashion which prevents the sensitive substances from being adversely affected during transport. The container has a main body having a first finger and a second finger with a generally U-shaped spring forming joint therebetween. The first finger has an upper surface upon which a container base portion is mounted. The container base portion has a threaded portion along the peripheral sides thereof, and a sealing surface at the upper reaches thereof. A cap is provided with threads complimentary to those on the outside of the container base portion, so that the cap can be removably affixed to the container base portion. A sealing portion, preferably of the O-ring type, is used to form a seal between the container base portion, at the sealing surface, and the cap. By tightly affixing the cap, a hermetic seal is provided, which substantially prevents ingress of undesirable liquids or gases which might otherwise tend to degrade or destroy substances, such as pharmaceuticals, stored in the container. An embodiment with an integral one-piece clip and container base portion is provided.

17 Claims, 3 Drawing Sheets

CONTAINER FOR MONEY CLIP

TECHNICAL FIELD OF THE INVENTION

This invention relates to a container carrying small objects such as pills, preferably for use in conjunction with a clip type device, and to a method of preserving and carrying pills via use of the container.

BACKGROUND OF THE INVENTION

A continuing demand exists for a simple, unobtrusive, and inexpensive container which can be used to store pills or the like while being carried by a person. Presently, the most common types of devices to carry pills involve bulky containers or prescription bottles. Such devices frequently provide unattractive and uncomfortable bulges in pockets, and often result in additional expense to repair or replace clothing which may be damaged while carting such bulky containers around.

The need to provide an unobtrusive container is particularly great at this time, especially for certain types of individuals for whom my type of money clip type pill container would be particularly useful, such as patients with a heart or other medical condition which requires constant availability of certain medications.

One of the most common deficiencies of the heretofore available pill box devices of which I am aware is their tendency to distort the shape of clothing in which they are placed, due to their extremely bulky shape. Thus, elimination of the need to use such undesirable and bulky containers would be advantageous for many folks, particularly for men who carry money clips in their pockets.

SUMMARY OF THE INVENTION

I have now invented, and disclose herein, a novel, improved pill box which does not have the above-discussed drawbacks common to those heretofore used pill boxes of which I am aware. Unlike the pill boxes or containers heretofore available, my product is simple, lightweight, relatively inexpensive, easy to manufacture, and otherwise superior to those heretofore used or proposed. In addition, it provides a hermetically sealed container which is easy to open and close, and a method for conveniently storing small amounts of medications in a hermetically sealed container.

I have disclosed and claimed herein a useful and novel hermetically sealed container in combination with a money clip device. The container has a main body having a first finger and a second finger with a generally U-shaped spring forming joint therebetween. The first finger has an upper surface upon which a container base portion is mounted. The container base portion has a threaded portion along the peripheral sides thereof, and a sealing surface at the upper reaches thereof. A cap is provided with threads complimentary to those on the outside of the container base portion, so that the cap can be removably affixed to the container base portion. A sealing portion, preferably of the O-ring type, is used to form a seal between the container base portion, at the sealing surface, and the cap. By tightly affixing the cap, a hermetic seal is provided, which substantially prevents ingress of undesirable liquids or gases which might otherwise tend to degrade or destroy substances, such as pharmaceuticals, stored in the container.

My improved pill container possesses the advantage that the container is preferably hermetically sealed, yet easily manually operable. This is because the cap for the container is preferably provided with easy to grasp frictional knurling along the periphery thereof.

In one embodiment, a U-shaped spring means is provided between a first portion and a second portion, and is integrally formed along with the first portion and the second portion from a single piece of material. Thus, no separate spring or spring mounting means is required, and as a result, there are no extra or extraneous parts to increase complexity of the device or the costs of manufacture.

A pill container made according to the teachings herein differ from previously available products of which I am aware in one respect in that hermetically sealed container is provided in combination with a simple, lightweight, easily used clip. When both the springs and the container base portion are integrally manufactured with the clip, as in the preferred configuration shown herein, my container will provide convenient carriage of objects such as pills, while generally being smaller in size and lighter in weight than conventional or previously available pill carrying devices.

OBJECTS, ADVANTAGES, AND FEATURES OF THE INVENTION

From the foregoing, it will be apparent to the reader that one important and primary object of the present invention resides in the provision of a novel, improved container to provide a means for easily, simply, securely, and unobtrusively carry a small object such as a pill.

Other important but more specific objects of the invention reside in the provision of a pill container as described in the preceding paragraph which:

- can be manufactured in a simple, straightforward manner;
- results in an effective pill container which can be hidden in use;
- have an integral spring means for securing objects such as folding money to the clip;
- have an integral sealing portion for hermetically sealing the pill container when the cap is tightly affixed thereto;
- in conjunction with the preceding objects, have the advantage that the pill box cap lips can be quickly engaged and disengaged; and therefore,
- provides a pill box which is easy to use and re-use; and as a result,
- provides a means and method for safely and reliably transporting an object in a hermetically sealed environment;
- provides a device which can easily be used for carriage of small quantities of pills or other small objects on the person.

Other important objects, features, and additional advantages of my invention will become apparent to the reader from the foregoing and the appended claims and as the ensuing detailed description and discussion proceeds in conjunction with the accompanying drawing.

Figure 1:
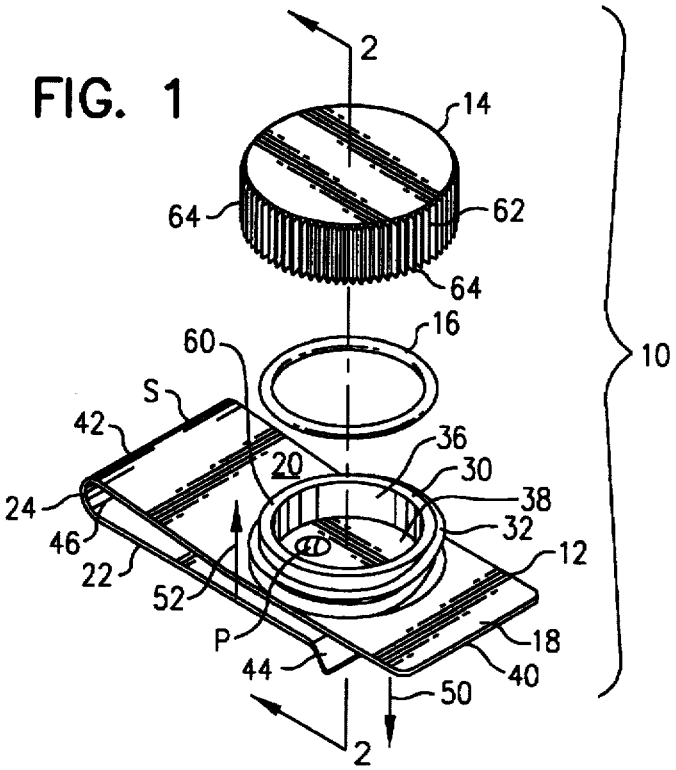
FIG. 1 is a perspective view of my novel container, showing a main body with first finger portion and second finger portion and a spring forming U-shaped joint therebetween, with a container base portion mounted on the first finger, and showing an O-ring type seal and cap.

In the various figures of the drawing, identical parts will be referred to with the same numerals, without further reference. Where similar parts are utilized in various embodiments, subsequent variations of the same feature may be referred to via use of a reference numeral with a "prime" (') mark, indicating that the part is similar to the description earlier provided for the same numeral without the prime sign, without further discussion thereof.

DETAILED DESCRIPTION OF THE INVENTION

Figure 2:
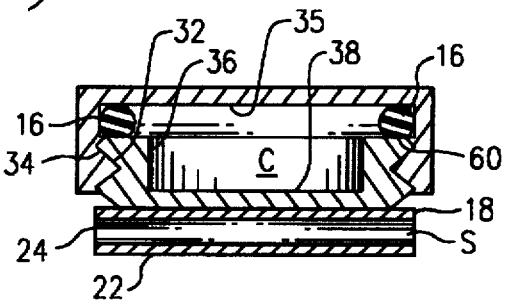
FIG. 2 is a vertical cross-sectional view of the container first illustrated in FIG. 1, now showing the cap in a secured, sealed and in-use position, and container base portion with threads complementary to threads in the cap, taken as if looking rearward along the line 2—2 of FIG. 1.

Referring to FIG. 1 of the drawing, in one embodiment, a clip mounted container 10 comprises a main body 12, a cap 14, and an O-ring type seal portion 16 for being sealingly located therebetween. The main body 12 has an upper or first finger 18 with an upper surface 20, a lower or second finger 22, a generally U-shaped joint 24 between the first 18 and second 22 fingers. A container base portion 30 is mounted on upper surface 20 of the first finger 18. The cap 14 is adapted to be securely but removably affixed to the container base portion 30, preferably by threaded meshing engagement via connection formed between complementary threaded sidewall portion 32 on the container base portion 30 and second threaded portion 34 (see FIG. 2) on the cap 14. Preferably, about 22 threads per inch are provided when using brass caps. When the cap 14 is in place on the container base portion 30, a container compartment C (see FIG. 2) is formed between the lower side 35 of cap 14 and the interior sidewalls 36 and bottom 38 of the container base portion 30. While caps may be of any convenient size, I believe that sizes of (a) about one (1) inch diameter, and (b) about one and one-half (1.5) inch diameter, will provide for compartments C of a size adequate and desirable for many purposes.

Again referring to FIG. 1, it can be seen that the first finger 18 has an outer or first end 40, and a second or inner end 42. The lower or second finger 22 has an outer or third end 44, and an inner or fourth end 46. The second end 42 on said first finger 18 and the fourth end 46 of the second finger 22 are joined by the generally U-shaped joint 24. The generally U-shaped joint 24 forms a spring S between the first finger 18 and the second finger 22. The spring S is biased toward a closed, contacting position in which said first finger 18 and second finger 22 are urged together, in the direction of reference arrows 50 and 52, respectively, to form a clasp between the first finger 18 and the second finger 22.

I prefer that the hermetic seal for chamber C be provided by a seal portion in the form of O-ring 16, but any convenient type of seal portion may be utilized between cap 14 and container base portion 30, so long as a sealingly acceptable joint is provided for the particular service of the apparatus 10. In any event, container base portion 30 should be provided with an appropriate seat surface 60 which allows the chosen seal portion to form a secure, hermetic type seal between the cap 14 and the container base portion 30. This sealing feature is important since it prevents damage to contents of the container by moisture or water; this is important with respect to certain pharmaceuticals.

For ease of operation, I prefer that the peripheral surface portion 62 of cap 14 be provided with knurling 64. The entire peripheral surface portion 62 can be provided with knurling as is shown in FIG. 1, or alternately, only a portion of peripheral surface portion 62' can have knurling 64' as shown on cap 14' in FIG. 3.

Figure 4:
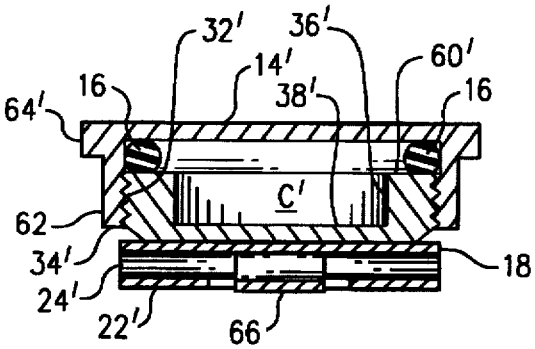
FIG. 4 is a cross-sectional view of the container just illustrated in FIG. 3, showing (a) the additional center prong spring portion on the second or lower finger portion, (b) knurling only on a portion of the cap, and (c) finer threads on the cap and complementary container base portion, taken looking rearward from the line 4—4 of FIG. 3.
Figure 5:
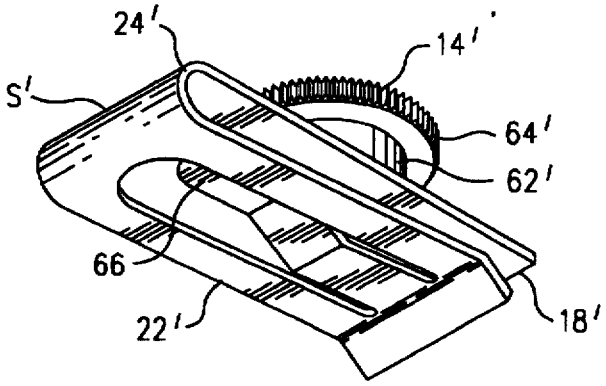
FIG. 5 is a bottom perspective view, looking up, at the embodiment just illustrated in FIGS. 3 and 4 above, showing the detail of the additional center prong spring portion, as well as the downwardly extending flange portion.
Figure 3:
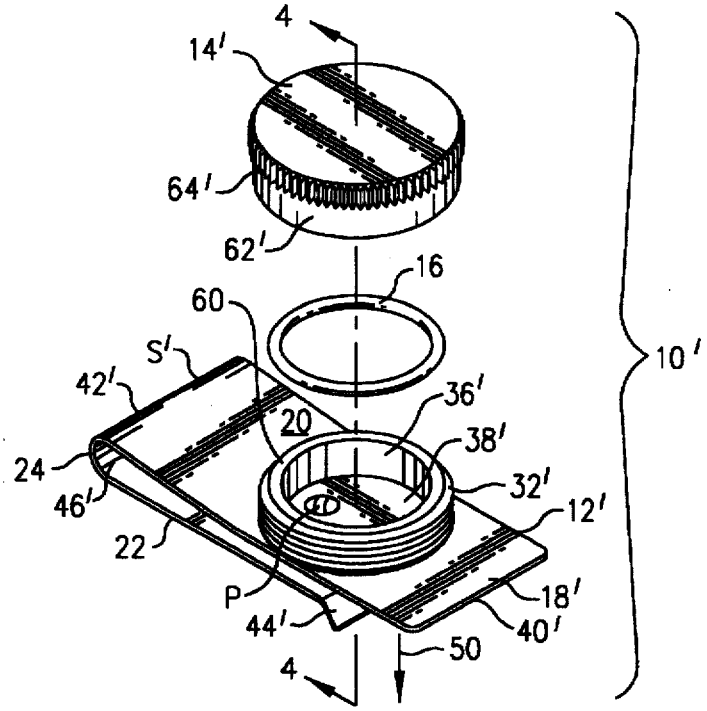
FIG. 3 is a top perspective view of a second embodiment of my novel container, shown similar to that in FIG. 1 above, but now including (a) an additional prong spring portion, on the second or lower finger portion, (b) knurling on only a portion of the cap, and (c) finer threads than those shown in FIG. 1 above, to enhance the seal formed when securing the cap.

As illustrated in the embodiment shown in FIGS. 3, 4, and 5, in order to enhance the clasping mechanism between first finger 18' and second finger 22', a center prong 66 can be provided, extending rearward toward the generally U-shaped joint 24' and upward toward first prong 18' from near the third end 44' of second finger 22'. This center prong enhances the ability of the clip to clasp materials such as folded monetary instruments, similar to that illustrated for example in FIG. 7 below and indicated by reference letter M.

As is shown in FIGS. 1, 3, and 5, I have also found it preferable to provide a clip 10 wherein the second finger 22 (FIG. 1) or 22' (FIGS. 3 and 5) has at the outer reaches thereof a downwardly extending first flange portion 70 (or 70', in FIGS. 3 and 5). The first flange portion 70 or 70' is adapted to receive an object and urge that object upward toward the first finger 18 or 18', so that the object can thence be secured in the clasp between the first finger (18 or 18') and the second finger (22 or 22') of the container clip 10.

Also, I prefer that at least the clip portion of main body portion 12 (i.e., main body 12 without container base portion 30), including first finger 18 and second finger 22, and the generally U-shaped joint 24 be integrally formed from a common unitary part. Generally, this is best provided in spring steel, in so far as the embodiments shown in FIGS. 1–5.

Figure 8:
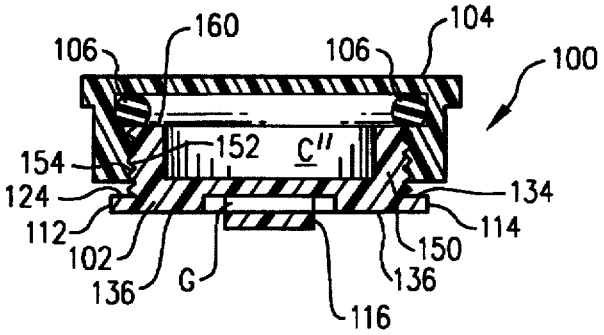
FIG. 8 is a vertical cross-sectional view of the embodiment just illustrated in FIG. 7 above, showing the integrally formed spring clip and container base portion, and cap with hermetic seal, taken as viewed looking rearward from the perspective of line 8—8 of FIG. 7.
Figure 7:
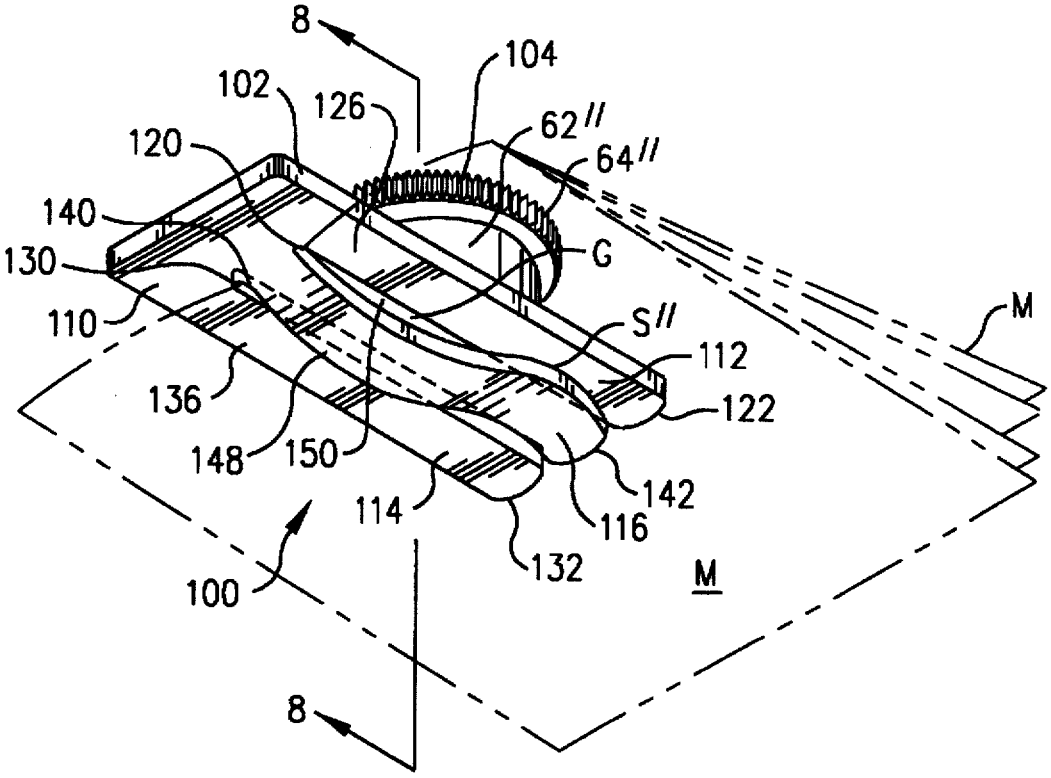
FIG. 7 is yet another embodiment of my novel pill container, similar to that just shown in FIG. 6 above, but with a somewhat smaller container.

Turning now to FIGS. 7 and 8, yet another embodiment is provided, showing an integrally formed container C" and clip apparatus 100. The apparatus 100 has an integrally formed main body portion 102, a cap 104, and a seal portion 106, preferably provided in the form of an O-ring type seal. The integrally formed main body portion 102 includes a rearwardly located union portion 110, a first prong 112, a second prong 114, and third or center prong 116 located between the first 112 and second 114 prongs. The first prong 112 has a proximal end 120 adjacent the union portion 110, and the first prong 112 protrudes outwardly from the proximal end 120 to a distal end 122. The first prong 112 has an upper surface portion 124 and a lower surface portion 126. The second prong 114 also has a proximal end 130 at the union portion 110, and protrudes outwardly from the proximal end 130 to a distal end 132. The second prong 114 has an upper surface portion 134 and a lower surface portion 136. The third prong 116 is located (in the transverse direction) between the first 112 and second 114 prongs. The third prong 116 also has a proximal end 140 at the union portion 110, and protrudes outwardly from the proximal end 140 in a direction preferably substantially parallel with the first 112 and second 114 prongs to a distal end 142. The third prong 116 cooperates with the union portion 110 to form a spring S" biased in a direction tending to urge the third prong 116 toward the lower surface portion 126 of the first prong 112 and the lower surface portion 136 of the second prong 114, so that the spring S" urges the third prong 116 to cooperate with said first and second prongs 112 and 114 to form a clasp therebetween, adapted to hold objects such as a monetary instrument M.

In a preferred embodiment, the third finger 116 extends somewhat downwardly with a bowed portion 148. The downwardly bowed portion 148 is adapted to accommodate an object thereabove and to urge the object being held toward a gripping position against the lower surface 126 of first prong 112, and against the lower surface portion 136 of second prong 114.

As seen in FIG. 8, a container base portion 150 is integrally formed with the main body portion 102, and sits above the upper surface portion 124 of the first prong 112 and the upper surface portion 134 of the second prong 114. Cap 104 is provided and is adapted to be securely affixed to the said container base portion 150, so as to form a closed container compartment C" between cap 104 and the container base portion 150. The container base portion 150 includes a first threaded portion 152, and the cap 104 includes a second threaded portion 154, which are complimentary so as to allow the cap 104 and the container base portion 150 to be brought into threaded meshing engagement, so as to attach the cap 104 to the container base portion 150. Preferably, the seal portion 106 is adapted to form a tight fitting seal between the container base portion 150 and the cap 104, so that when the cap 104 is tightly secured to the container base portion 150, the closed container compartment C" is hermetically sealed. Depending upon seal type chosen, a seat 160 is provided at the upper reaches of the container base portion 150 to advantageously accomplish the necessary sealing function.

Ideally, the integrally formed main body portion 102 is formed from a suitable moldable polymer, such as acatel type plastic. Cap 104 may also be formed from acatel type polymer.

Figure 6:
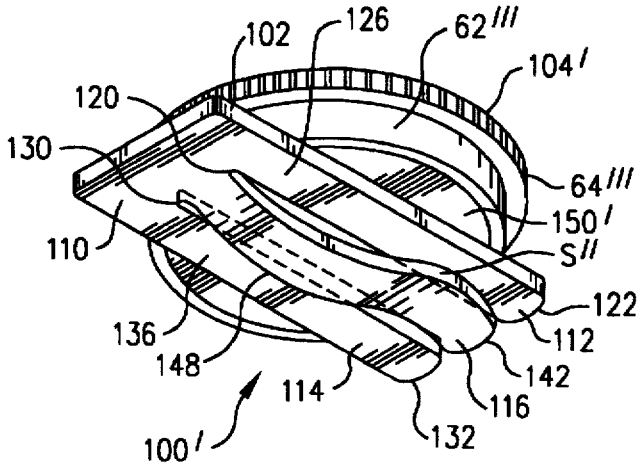
FIG. 6 is another embodiment of my novel pill container, shown an integrally formed clip and container base portion, with a relatively large size container.

Returning to FIG. 6, yet another embodiment 100' of my pill container is depicted, with construction similar to that first shown in FIG. 7. However, the container base portion 150' and cap 104' are provided in a larger size, suitable for holding larger pills.

Finally, the operation of the clip portion of my container 100 may be seen in the bottom perspective view seen in FIG. 7, with reference to FIG. 8. In FIG. 7, a folded monetary instrument M is provided with a creased portion 200 for insertion at the distal end of, and between third prong 116 and the other first and second prongs 112 and 114, respectively. The instrument M is urged generally toward the gap G near the proximal end of the third prong 116, and upward against the lower surfaces 126 and 136 of first and second prongs 112 and 114.

Returning now to FIGS. 1 and 3, it can be seen that my improved pill container design, as depicted by reference numeral 10 and 10' possesses the advantage that a securely sealed compartment C or C' is formed. As a result, the stability and security of pills P located in the compartments C and C' is assured.

In many cases, the actual materials of construction used for forming the securely sealed compartment C or C' may be important with respect to assuring that the material to be carried does not react with the container C or C' itself. Such a result can be achieved by assuring the the compartment C has been coated or plated with a substantially inert material with respect to the compound to be carried in the container. For example with heart patients, use of formulation of nitroglycerine is often prescribed, and it is desirable for the patient to carry with them at all times an effective dosage amount of the nitroglycerine. Use of gold plating in the interior sidewalls 36 and bottom 38 of the container base portion 30, as well as in the lower side 35 of cap 14, is advantageous to assure that the nitroglycerine remains unaffected by storage in my novel container.

It will be readily apparent to the reader that the present invention may be easily adapted to other embodiments incorporating the concepts taught herein and that the present embodiments illustrated are shown by way of example only and shall not in any way be a limitation. For example, other sealed container variations may be provided to accommodate the hermetic sealing of an object in a container in combination with a clip such as a money clip. As to various embodiments illustrated in drawing, like parts have been noted with common reference numerals without further discussion thereof.

Thus, it can be seen that I have developed and have set forth herein an exemplary clip mounted container. The container is ideal for sealingly holding a pill or other small object in a closed container. The clip mounted container is simple to manufacture, and is compact and lightweight, making it easy to hide in use, and does not tend to cause damage to clothing as with prior art pill carriers. The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalences of the claims are therefore intended to be embraced therein.

I claim:

1. A clip mounted container for protective carriage of moisture sensitive substances, to effectively protect said substances against hydrous contamination, said clip mounted container comprising:

(a) a main body, said main body comprising (i) a first finger, said first finger comprising (A) a first end, (B) a second end, and (C) an upper surface portion, and (ii) a second finger, said second finger comprising a third and a fourth end, wherein said second end of said first finger and said fourth end of said second finger extend to (iii) a generally U-shaped joint, said U-shaped joint forming a spring between said first finger and said second finger, said spring biased toward a closed, contacting position in which said first and second fingers are urged together to form a clasp therebetween, and (iv) a container base portion, said container base portion further comprising (A) a first threaded portion, and (B) a seal portion seat, said seal portion seat located at the upper reaches of said container base portion;

(b) a cap, and wherein said cap further comprises
(i) a lower side portion, and
(ii) a second threaded portion, and
(iii) wherein said first and said second threaded portions are complementary, so that said cap and said container base portion are adapted for threaded meshing engagement, enabling said cap to be securely affixed to said container base portion, so as to form a container compartment between said cap and said container base portion; and (c) a single waterproof O-ring seal portion, said seal portion adapted to form a single waterproof seal between said lower side portion of said cap and said seal portion seat and said cap, so that when said cap is tightly secured to said container base portion, said container compartment is hermetically sealed so as to form a waterproof compartment for carriage of said water sensitive substances.

2. The apparatus as set forth in claim 1, wherein said cap further comprises a peripheral surface portion, and wherein at least a portion of said peripheral surface portion is knurled.

3. The apparatus as set forth in claim 1, wherein substantially the entire peripheral surface portion of said cap is knurled.

4. The apparatus as set forth in claim 1, wherein said first finger, said second second finger, and said generally U-shaped joint are integrally formed from a common unitary part.

5. The apparatus as set forth in claim 4, wherein said common unitary part is comprised of spring steel.

6. The apparatus as set forth in claim 1, wherein said second finger further comprises a downwardly extending first flange portion, said first flange portion adapted to receive an object and urge said object toward said clasp between said first finger and said second finger.

7. A clip mounted container for protective carriage of moisture sensitive substances, to effectively protect against moisture contamination of said substances, said clip mounted container comprising:

(a) a main body, said main body comprising
(i) a union portion, and
(i) a first prong, said first prong comprising a proximal end at said union portion, said first prong protruding from said union portion to a distal end, said first prong further comprising an upper surface portion and a lower surface portion,
(ii) a second prong, said second prong comprising a proximal end at said union portion, said second prong protruding from said union portion to a distal end, said second prong further comprising an upper surface portion and a lower surface portion,
(iii) a third prong, said third prong located, in the transverse direction, between said first and said second prongs, said third prong comprising a proximal end at said union portion, said third prong protruding longitudinally in a direction substantially parallel with said first and said second prongs from said union portion to a distal end, said third prong cooperating with said union portion to form a spring biased in a direction tending to urge said third prong toward lower surface portion of said first prong and toward said lower surface portion of said second prong, so as to urge said third prong to cooperate with said first and second prongs to form a clasp therebetween, and
(iv) a container base portion, said container base portion further comprising
(i) a first threaded portion, and
(ii) a seal portion seat, said seal portion seat located at the upper reaches of said container base portion;

(b) a cap, and wherein said cap further comprises
(i) a lower side portion, and
(ii) a second threaded portion, and
(iii) wherein said first and said second threaded portions are complementary, so that said cap and said container base portion are adapted for threaded meshing engagement, enabling said cap to be securely affixed to said container base portion, so as to form a container compartment between said cap and said container base portion;

(c) a waterproof O-ring seal portion, said seal portion adapted to form a waterproof seal between said lower side portion of said cap and said seal portion seat and said cap, so that when said cap is tightly secured to said container base portion, said container compartment is hermetically sealed so as to form a waterproof compartment for carriage of said water sensitive substances.

8. The apparatus as set forth in claim 7, wherein said cap further comprises a peripheral surface portion, and wherein at least a portion of said peripheral surface portion is knurled.

9. The apparatus as set forth in claim 7, wherein substantially the entire peripheral surface portion of said cap is knurled.

10. The apparatus as set forth in claim 7, wherein said union portion, said first prong, said second prong, and said third prong, and said container base portion are integrally formed in an integral one-piece main body portion.

11. The apparatus as set forth in claim 10 wherein said main body portion is comprised of acetal polymer.

12. The apparatus as set forth in claim 7, wherein said third finger further comprises a downwardly extending bowed portion, said downwardly extending bowed portion adapted to accommodate an object thereabove and to urge said object toward a gripping position against said lower portion of said first prong and said second prong.

13. The apparatus as set forth in claim 1 or claim 7, wherein said a container base portion further comprises a bottom portion, and wherein said bottom portion is gold coated or plated.

14. The apparatus as set forth in claim 1 or claim 7, wherein said a container base portion further comprises an interior sidewall portion, and wherein said interior sidewall portion is gold coated or plated.

15. The apparatus as set forth in claim 1 or 7, wherein said cap further comprises a lower side portion, and wherein said lower side portion is gold coated or plated.

16. The apparatus as set forth in claim 1 or claim 7, wherein (a) said container base portion further comprises
(i) a bottom portion, and
(ii) an interior sidewall portion, and (b) wherein said bottom portion, said interior sidewall portion, and said lower side portion are gold plated, so as to provide substantially unreactive surface walls in said compartment for storing a preselected, moisture sensitive, reactive substance therein.

17. The apparatus as set forth in claim 1 or claim 7, wherein said apparatus is gold plated.

* * * * *